US008899675B2

(12) United States Patent
Wu et al.

(10) Patent No.: US 8,899,675 B2
(45) Date of Patent: Dec. 2, 2014

(54) HEAT VENTILATING CHAIR

(75) Inventors: Tai-Hsi Wu, Kaohsiung (TW); Yi-Hao Chang, Kaohsiung (TW); Chi-Sheng Wang, Kaohsiung (TW); Kuo-Liang Lin, Kaohsiung (TW)

(73) Assignee: I-Shou University, Kaohsiung (TW)

( * ) Notice: Subject to any disclaimer, the term of this patent is extended or adjusted under 35 U.S.C. 154(b) by 472 days.

(21) Appl. No.: 13/287,861

(22) Filed: Nov. 2, 2011

(65) Prior Publication Data

US 2013/0106149 A1 May 2, 2013

(51) Int. Cl.
*A47C 7/74* (2006.01)

(52) U.S. Cl.
CPC ..... *A47C 7/744* (2013.01)
USPC ..... 297/180.16; 297/452.42; 297/452.46

(58) Field of Classification Search
USPC ..... 297/180.16, 452.41, 452.42, 452.16; 454/120, 904
See application file for complete search history.

(56) References Cited

U.S. PATENT DOCUMENTS

| | | | | |
|---|---|---|---|---|
| 580,284 | A * | 4/1897 | Krieg | 297/180.16 |
| 847,238 | A * | 3/1907 | Carroll | 454/105 |
| 1,118,353 | A * | 11/1914 | Jurkowski | 297/180.16 |
| 1,600,915 | A * | 9/1926 | Verka | 297/180.16 |
| 7,364,229 | B2 * | 4/2008 | Lee | 297/180.16 |
| 8,033,600 | B2 * | 10/2011 | Reynolds et al. | 297/216.1 |

* cited by examiner

*Primary Examiner* — David R Dunn
*Assistant Examiner* — Richard Lowry
(74) *Attorney, Agent, or Firm* — Jianq Chyun IP Office

(57) ABSTRACT

A heat ventilating chair includes a backrest unit, a seat unit, and a connecting unit connecting the backrest unit to the seat unit. One of the backrest unit and the seat unit includes a hollow member having an air pump, a pressure valve, and a channel that communicates fluidly the air pump and the pressure valve. The connecting unit is connected between the air pump and the other one of the backrest unit and the seat unit. The connecting unit drives the air pump to expel hot air in the channel to the ambient via the pressure valve when the backrest unit is forced to incline rearward. The connecting unit drives the air pump to draw ambient cool air into the channel via the pressure valve when the backrest unit is restored from a rearwardly inclined state.

11 Claims, 9 Drawing Sheets

HEAT VENTILATING CHAIR

BACKGROUND OF THE INVENTION

1. Field of the Invention

The invention relates to a chair, more particularly to a heat ventilating chair.

2. Description of the Related Art

Referring to FIG. 1, Taiwanese Utility Model No. M272466 discloses a conventional heat ventilating chair comprising a ventilating mechanism that includes a base pad 14, an air guiding pad 12, and a ventilation pad 11, that are arranged in a stack enclosed by an air-permeable decorative covering 15.

The ventilation pad 11 is formed with a plurality of air passages 111 extending therethrough. The air guiding pad 12 is formed with a plurality of channels 121 (only one is shown) that are in spatial communication with the air passages 111, and has a rear open end. A ventilating device 13 is disposed in the rear open end of the air guiding pad 12.

The ventilating device 13 can be activated to create air flow such that hot air in the channels 121 of the air guiding pad 12 is expelled to the ambient via the air passages 111 and the decorative covering 15.

However, electricity is required for operation of the ventilating device 13, thereby resulting in additional power cost.

SUMMARY OF THE INVENTION

Therefore, the object of the invention is to provide a heat ventilating chair capable of eliminating the above drawback of the prior art.

Accordingly, the heat ventilating chair of the present invention comprises a backrest unit, a seat unit, and a connecting unit connecting the backrest unit at an angle relative to the seat unit. One of the backrest unit and the seat unit includes at least one hollow member having an air pump, a pressure valve that is spaced apart from the air pump, and a channel that communicates fluidly the air pump and the pressure valve. The connecting unit is connected between the air pump and the other one of the backrest unit and the seat unit. The connecting unit moves in a first direction to drive the air pump to expel hot air in the channel of the hollow member to the ambient via the pressure valve when the backrest unit is forced to incline rearward relative to the seat unit. The connecting unit moves in a second direction opposite to the first direction to drive the air pump to draw ambient cool air into the channel of the hollow member via the pressure valve when the backrest unit is restored from a rearwardly inclined state relative to the seat unit.

BRIEF DESCRIPTION OF THE DRAWINGS

Other features and advantages of the invention will become apparent in the following detailed description of the preferred embodiments with reference to the accompanying drawings, of which.

DETAILED DESCRIPTION OF THE PREFERRED EMBODIMENTS

Figure 1:
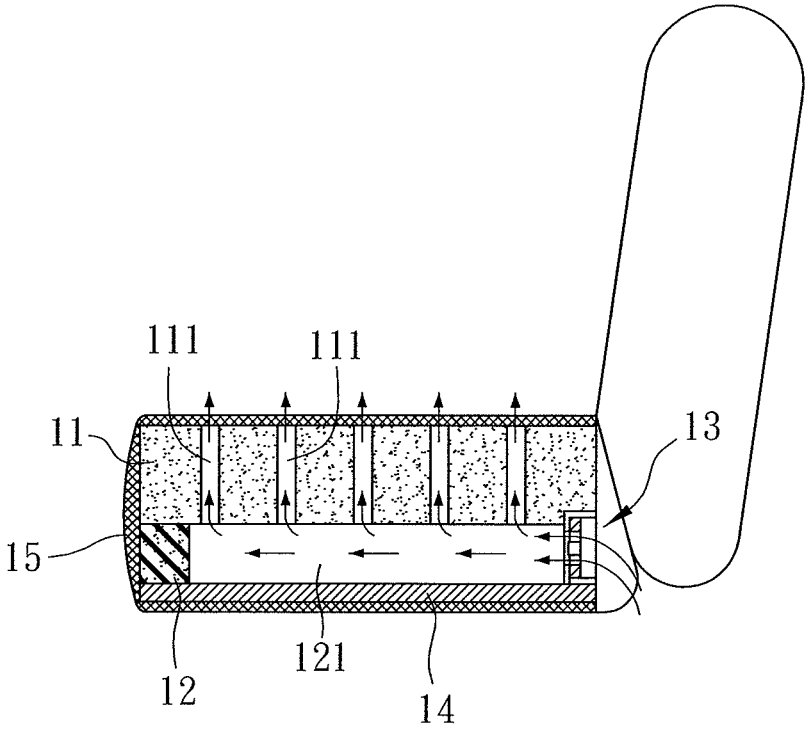
FIG. 1 PRIOR ART
FIG. 1 is a schematic partly sectional view of a conventional heat ventilating chair disclosed in Taiwanese Utility Model No. M272466.

Before the invention is described in greater detail with reference to the accompanying embodiments, it should be noted herein that like elements are denoted by the same reference numerals throughout the disclosure.

Figure 2:
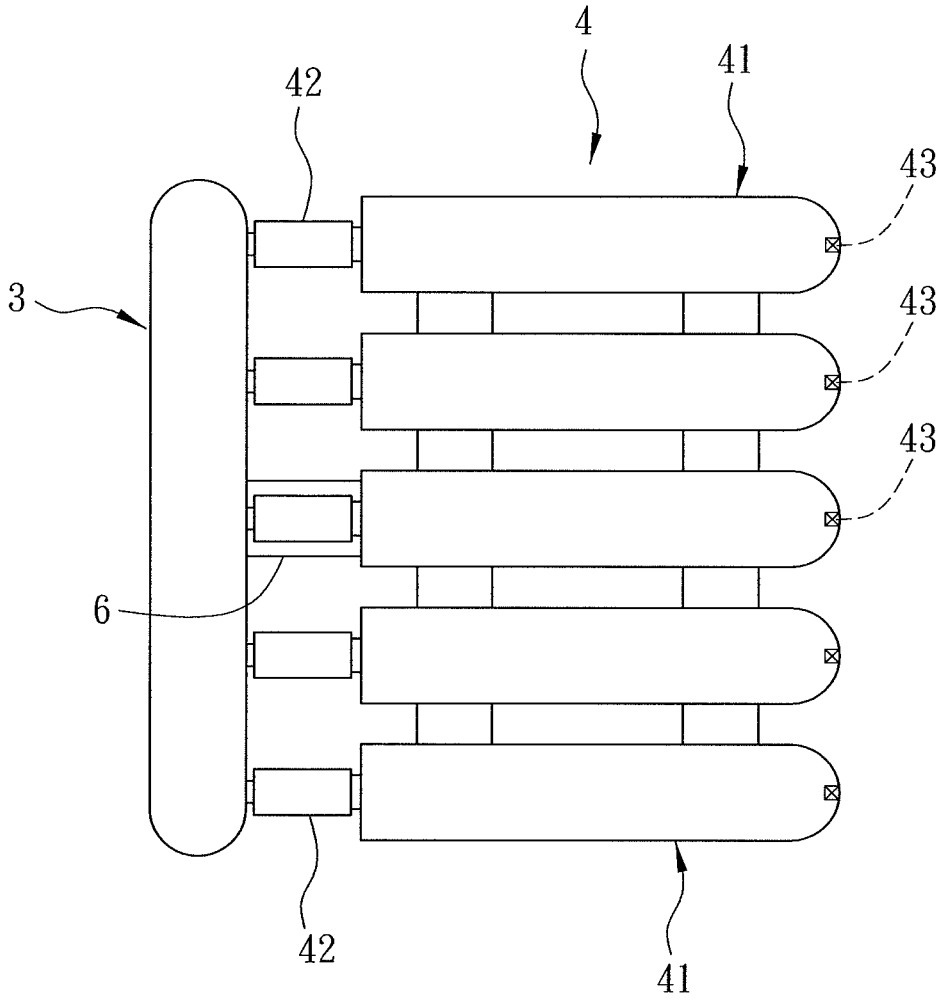
FIG. 2 is a schematic top view of a first preferred embodiment of a heat ventilating chair according to the present invention.
Figure 3:
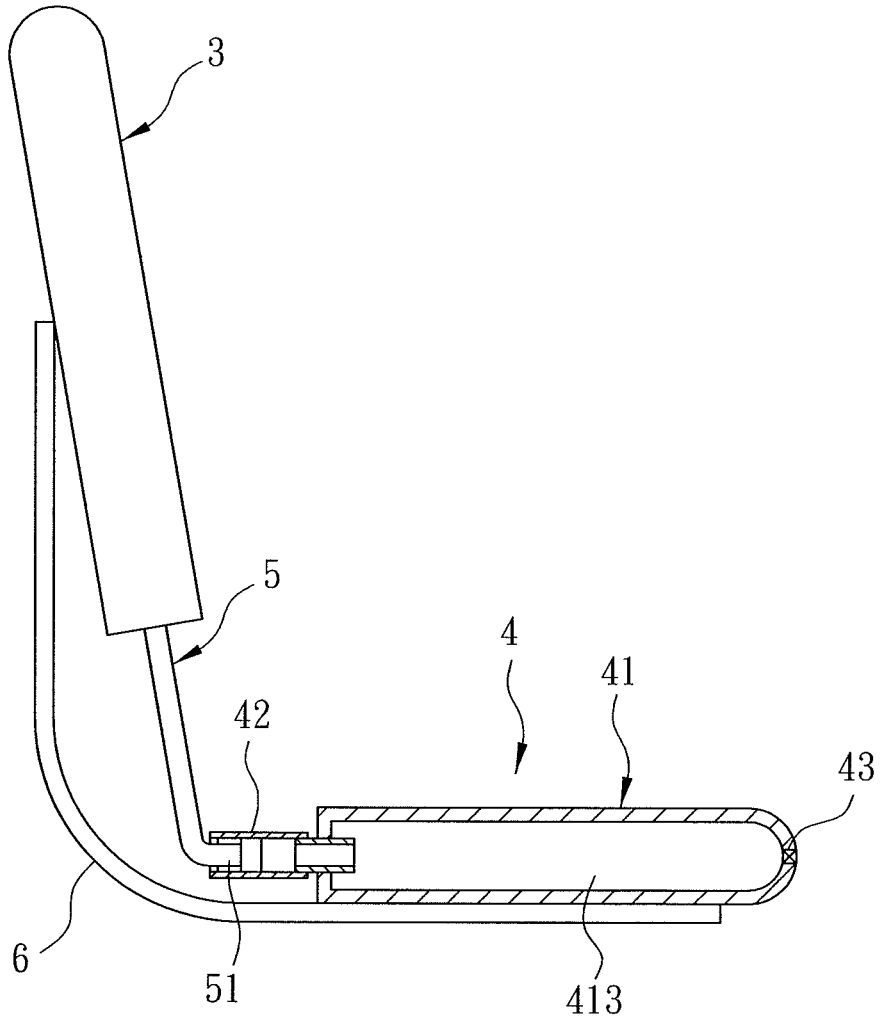
FIG. 3 is a schematic partly sectional view of the first preferred embodiment.

Referring to FIGS. 2 and 3, a first preferred embodiment of a heat ventilating chair according to the present invention is shown. The heat ventilating chair comprises a backrest unit 3, a seat unit 4, a connecting unit 5, and a restoring member 6.

In this embodiment, the seat unit 4 includes a plurality of hollow members 41 arranged parallel to and spaced apart from each other. Each of the hollow members 41 has an air pump 42, a pressure valve 43 spaced apart from the air pump 42, and a channel 413 communicating fluidly the air pump 42 and the pressure valve 43. In this embodiment, the pressure valve 43 is configured as a two-way valve.

The connecting unit 5 includes a plurality of bent connecting members 51 (only one is visible in FIG. 3), each being connected between the air pump 42 of respective one of the hollow members 41 and the backrest unit 3 such that the backrest unit 3 is connected at an angle relative to the seat unit 4.

In this embodiment, the restoring member 6 is configured as a bent leaf spring and has opposite ends connected respectively to a rear side of the backrest unit 3 and a bottom side of a middle one of the hollow members 41 of the seat unit 4.

To conduct ventilation of the heat ventilating chair of this invention, a user seated on the heat ventilating chair leans rearwardly against the backrest unit 3 to force the backrest unit 3 to incline rearward relative to the seat unit 4 such that the connecting unit 5 moves in a forward direction and that the bent connecting members 51 drive respectively the air pumps 42 to expel hot air in the channels 413 of the hollow members 41 to the ambient via the pressure valves 43. At the same time, the restoring member 6 is stretched resiliently to thereby store a restoring force.

Afterwards, when the user inclines forwardly, the backrest unit 3 is biased by the restoring force of the restoring member 6 to be restored from a rearwardly inclined state relative to the seat unit 4, thereby moving the connecting unit 5 in a rearward direction such that the bent connecting members 51 drive the air pumps 42 respectively to draw ambient cool air into the channels 413 of the hollow members 41 via the pressure valves 43.

Consequently, ventilation in the heat ventilating chair can be achieved simply by the movement of the user's body without use of the ventilating device 13 as illustrated in FIG. 1.

Figure 4:
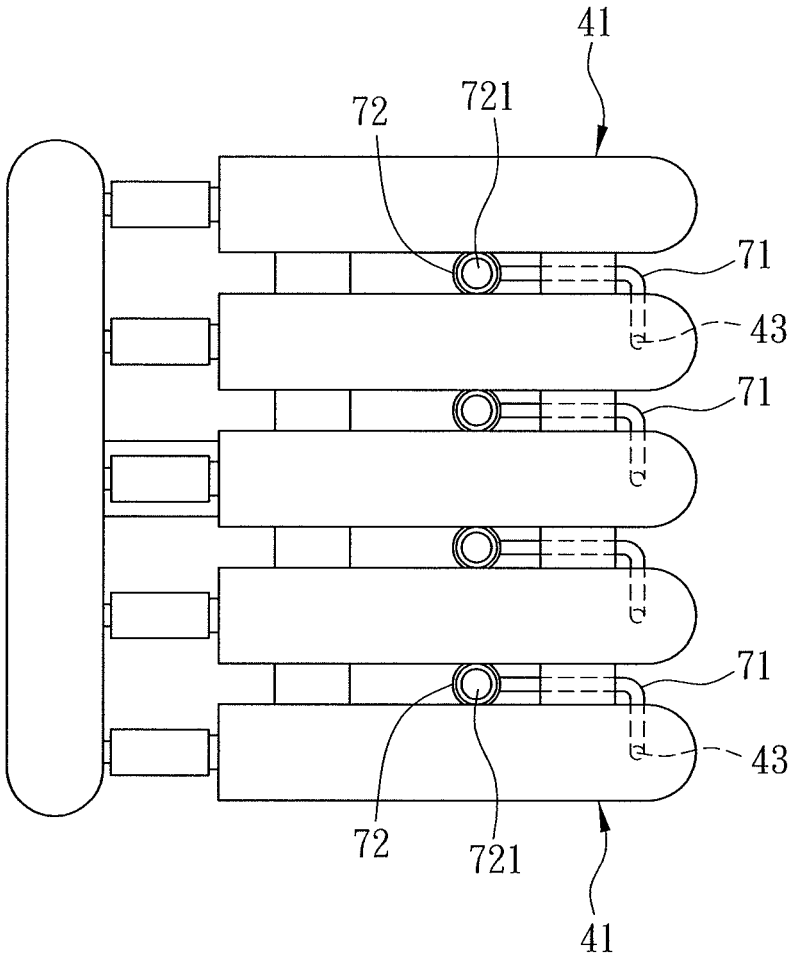
FIG. 4 is a schematic top view of a second preferred embodiment of the heat ventilating chair according to the present invention.
Figure 5:
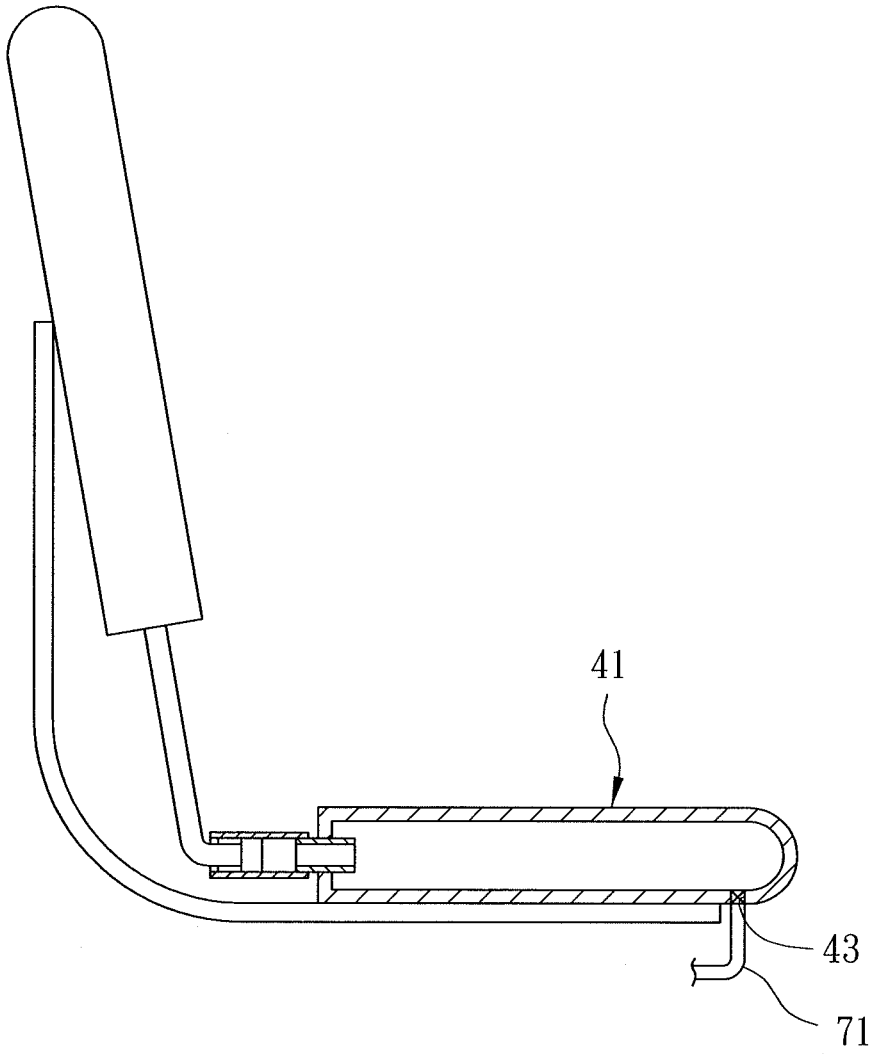
FIG. 5 is a fragmentary schematic partly sectional view of the second preferred embodiment.

Referring to FIGS. 4 and 5, a second preferred embodiment of the heat ventilating chair according to the present invention is shown. The main difference between this embodiment and the first embodiment resides in the following. In this embodiment, the heat ventilating chair further comprises a plurality of air guide tubes 71 and a plurality of bidirectional flow tubes 72.

Each of the air guide tubes 71 has opposite ends connected respectively to a respective one of the hollow members 41 at the pressure valve 43 thereof and to a middle segment of a respective one of the bidirectional flow tubes 72 so that the hot air expelled from the hollow members 41 is released to the ambient via the air guide tubes 71 and the bidirectional flow tubes 72.

Figure 6:
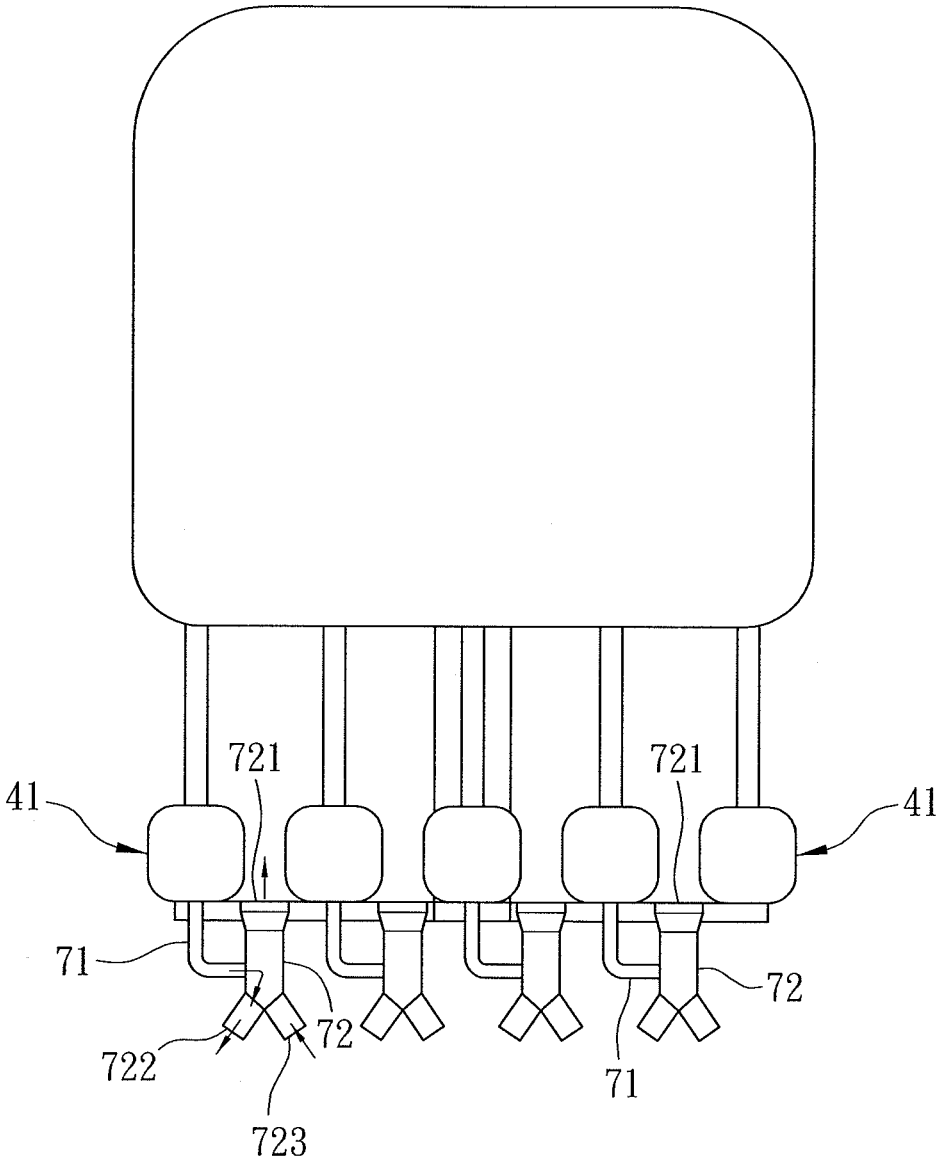
FIG. 6 is a schematic front view of the second preferred embodiment.
Figure 7:
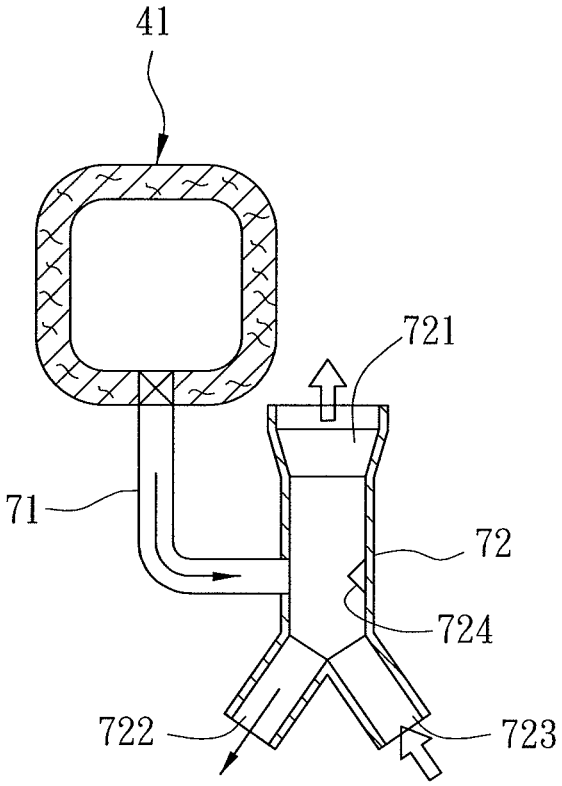
FIG. 7 is an enlarged partly sectional view of an air guide tube and a bidirectional flow tube of the second preferred embodiment.

Further referring to FIGS. 6 and 7, each of the bidirectional flow tubes 72 is an inverted Y-shaped tube having a cool air discharge port 721, a hot air discharge port 722, and a cool air inlet port 723. The cool air discharge port 721 forms an upper part of the inverted Y-shaped tube, and the hot air discharge port 722 and the cool air inlet port 723 form a lower part of the inverted Y-shaped tube.

The middle segment of each of the bidirectional flow tubes 72 has an inner wall surface provided with a flow guide block 724 at a position corresponding to a connection junction with the respective one of the air guide tubes 71, such that while hot air from each of the air guide tubes 71 is being expelled by the respective one of the bidirectional flow tubes 72 with guidance by the flow guide block 724, ambient cool air is being simultaneously drawn into the cool air inlet port 723 of the respective one of the bidirectional flow tubes 72 and flows through the cool air outlet port 721 of the corresponding one of the bidirectional flow tubes 72. While the second preferred embodiment has the same advantages as those of the first preferred embodiment, ambient cool air expelled via the cool air outlets 721 of the bidirectional flow tubes 72 can be directed toward the user seated on the heat ventilating chair so as to further provide a cool feeling for the user.

Figure 8:
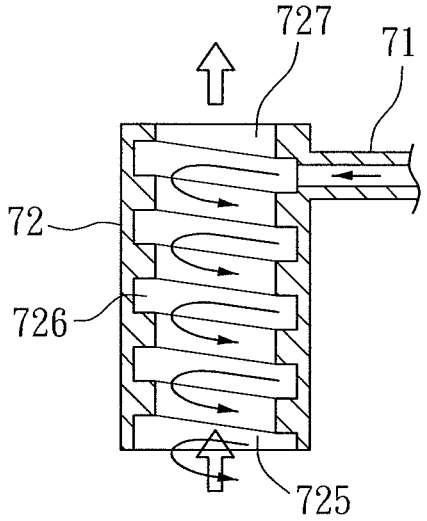
FIG. 8 is an enlarged fragmentary sectional view of an air guide tube and a bidirectional flow tube of a third preferred embodiment of the heat ventilating chair according to the present invention.
Figure 9:
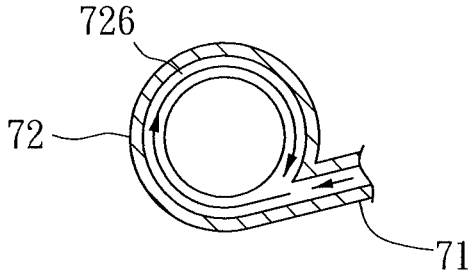
FIG. 9 is an enlarged sectional view of the air guide tube and the bidirectional flow tube of the third preferred embodiment.

Referring to FIGS. 8 and 9, a third preferred embodiment of the heat ventilating chair is shown. The main difference between this embodiment and the second embodiment resides in the configuration of the bidirectional flow tubes 72. In this embodiment, each of the bidirectional flow tubes 72 has an upper part formed as a cool air discharge port 727, an opposite lower part formed as a cool air inlet port 725, and an inner wall surface formed with a spiral groove 726.

Each of the air guide tubes 71 has opposite ends connected respectively to the respective one of the hollow members 41 at the pressure valve 43 thereof and to the respective one of the bidirectional flow tubes 72 at one end of the spiral groove 726 that is proximate to the cool air discharge port 727 of the respective one of the bidirectional flow tubes 72.

While ambient cool air enters the cool air inlet port 725 of each bidirectional flow tube 72 and exits the cool air outlet port 727, hot air from the respective one of the air guide tubes 71 flows simultaneously along the spiral groove 726 of the corresponding bidirectional flow tube 72 and is subsequently released at the cool air inlet port 725 of the corresponding bidirectional flow tube 72. The third preferred embodiment has the same advantages as those of the second preferred embodiment.

Figure 10:
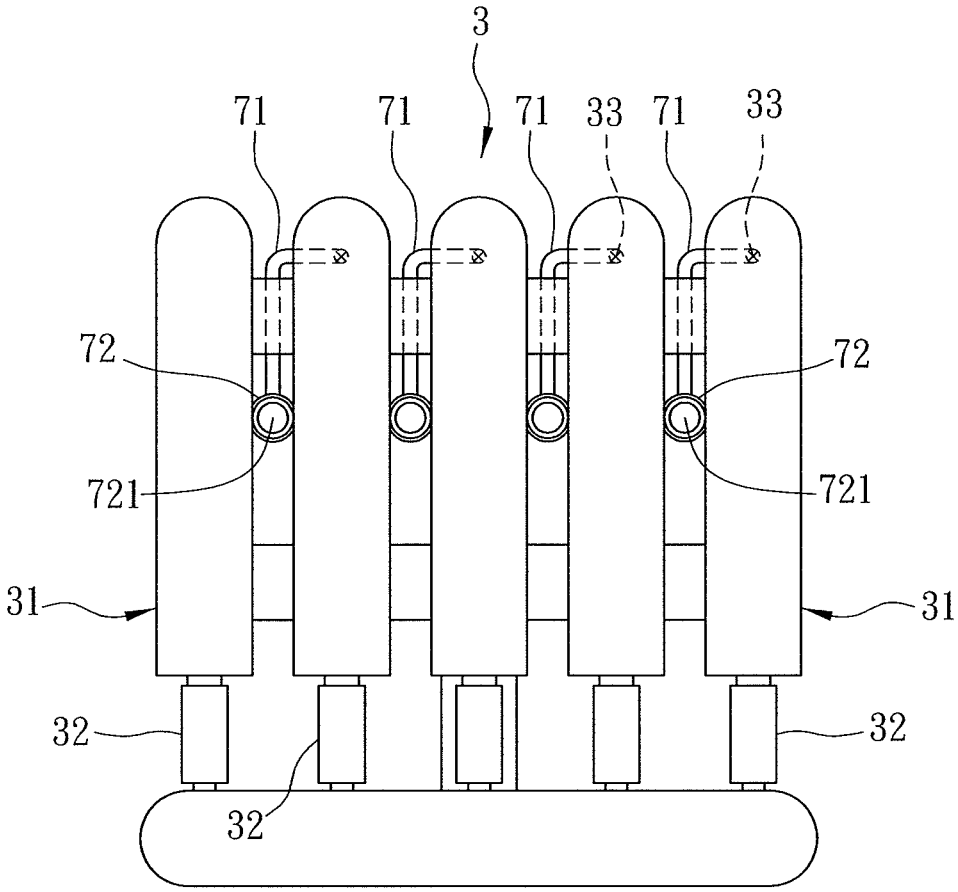
FIG. 10 is a schematic front view of a fourth preferred embodiment of the heat ventilating chair according to the present invention.

FIG. 10 illustrates a fourth preferred embodiment of the heat ventilating chair according to the invention. The main difference between this embodiment and the second embodiment resides in the position where the hollow members are disposed. In this embodiment, the backrest unit 3 includes a plurality of hollow members 31, each having an air pump 32, a pressure valve 33 that is spaced apart from the air pump 32, and a channel 313 that communicates fluidly the air pump 32 and the pressure valve 33.

Each of the air guide tubes 71 has opposite ends connected respectively to a respective one of the hollow members 31 at the pressure valve 33 thereof and to a respective one of the bidirectional flow tubes 72 so that the hot air expelled from the hollow members 31 is released to the ambient via the air guide tubes 71 and the bidirectional flow tubes 72. The cool air discharge port 721 of each of the bidirectional flow tubes 72 are disposed to face a front side of the backrest unit 3, and the hot air discharge port 722 and the cool air inlet port 723 (not shown) of each of the bidirectional flow tubes 72 is disposed to face a rear side of the backrest unit 3. The fourth preferred embodiment has the same advantages to be like those of the second preferred embodiment. It should be noted that the bidirectional flow tubes 72 in this embodiment may also be configured as those illustrated in FIGS. 8 and 9.

While the invention has been described in connection with what are considered the most practical and embodiments, it is understood that this invention is not limited to the disclosed embodiment but is intended to cover various arrangements included within the spirit and scope of the broadest interpretation so as to encompass all such modifications and equivalent arrangements.

What is claimed is:

1. A heat ventilating chair comprising a backrest unit, a seat unit, and a connecting unit connecting said backrest unit at an angle relative to said seat unit;

wherein one of said backrest unit and said seat unit includes at least one hollow member having an air pump, a pressure valve that is spaced apart from said air pump, and a channel that communicates fluidly said air pump and said pressure valve;

wherein said connecting unit is connected between said air pump and the other one of said backrest unit and said seat unit;

wherein said connecting unit moves in a first direction to drive said air pump to expel hot air in said channel of said hollow member to the ambient via said pressure valve when said backrest unit is forced to incline rearward relative to said seat unit; and wherein said connecting unit moves in a second direction opposite to said first direction to drive said air pump to draw ambient cool air into said channel of said hollow member via said pressure valve when said backrest unit is restored from a rearwardly inclined state relative to said seat unit.

2. The heat ventilating chair as claimed in claim 1, wherein said one of said backrest unit and said seat unit includes a plurality of said hollow members, and said connecting unit includes a plurality of bent connecting members, each being connected between said air pump of a respective one of said hollow members and said other one of said backrest unit and said seat unit.

3. The heat ventilating chair as claimed in claim 2, wherein said hollow members are arranged parallel to each other.

4. The heat ventilating chair as claimed in claim 1, further comprising at least one air guide tube and at least one bidirectional flow tube, said air guide tube having opposite ends that are respectively connected to said hollow member at said pressure valve and to said bidirectional flow tube so that the hot air expelled from said hollow member is released to the ambient via said air guide tube and said bidirectional flow tube.

5. The heat ventilating chair as claimed in claim 4, wherein said bidirectional flow tube is a Y-shaped tube having a cool air discharge port, a hot air discharge port, and a cool air inlet port, said air guide tube being connected to a middle segment of said bidirectional flow tube.

6. The heat ventilating chair as claimed in claim 5, wherein said seat unit includes said at least one hollow member, and wherein said cool air discharge port forms an upper part of said Y-shaped tube and said hot air discharge port and said cool air inlet port form a lower part of said Y-shaped tube.

7. The heat ventilating chair as claimed in claim 5, wherein said backrest unit includes said at least one hollow member, and wherein said cool air discharge port is disposed to face a front side of said backrest unit, and said hot air discharge port and said cool air inlet port are disposed to face a rear side of said backrest unit.

8. The heat ventilating chair as claimed in claim 5, wherein said middle segment of said bidirectional flow tube has an inner wall surface provided with a flow guide block at a position corresponding to a connection junction with said air guide tube, such that while hot air from said air guide tube is being expelled by said bidirectional flow tube with guidance by said flow guide block, ambient cool air is being simultaneously drawn into said cool air inlet port and flows through said cool air outlet port.

9. The heat ventilating chair as claimed in claim 4, wherein said bidirectional flow tube has one end formed as a cool air discharge port, and an opposite end formed as a cool air inlet port, said bidirectional flow tube further having an inner wall surface that is formed with a spiral groove, said air guide tube being connected to said bidirectional flow tube at one end of said spiral groove that is proximate to said cool air discharge port, wherein, while ambient cool air enters said cool air inlet port of said bidirectional flow tube and exits said cool air outlet port of said bidirectional flow tube, hot air from said air guide tube flows simultaneously along said spiral groove of said bidirectional flow tube and is subsequently released at said cool air inlet port of said bidirectional flow tube.

10. The heat ventilating chair as claimed in claim 9, wherein said seat unit includes said at least one hollow member, and wherein said cool air discharge port forms an upper part of said bidirectional flow tube and said cool air inlet port forms a lower part of said bidirectional flow tube.

11. The heat ventilating chair as claimed in claim 9, wherein said backrest unit includes said at least one hollow member, and wherein said cool air discharge port is disposed to face a front side of said backrest unit, and said cool air inlet port is disposed to face a rear side of said backrest unit.

* * * * *